United States Patent [19]

Roach et al.

[11] 4,282,721

[45] Aug. 11, 1981

[54] EAR ORNAMENT

[76] Inventors: Sally A. Roach, 222 Pearson East, Apt. 301; Rob R. Hansen, 70 E. Walton, Apt. 4D, both of Chicago, Ill. 60611

[21] Appl. No.: 145,426

[22] Filed: May 1, 1980

[51] Int. Cl.[3] ..... A44C 7/00

[52] U.S. Cl. ..... 63/14 R; D11/28; D11/42

[58] Field of Search ..... 63/14 A, 14 G, 14 R; D11/3, 42, 28

[56] References Cited

FOREIGN PATENT DOCUMENTS

| | | | |
|---|---|---|---|
| 755650 | 9/1933 | France | 63/14 G |
| 2242946 | 4/1975 | France | 63/14 A |
| 2256737 | 8/1975 | France | 63/14 R |
| 7563 | of 1911 | United Kingdom | 63/14 A |

*Primary Examiner*—E. Barry Shay

*Attorney, Agent, or Firm*—Garrettson Ellis

[57] ABSTRACT

An ear ornament comprises an elongated, curved rod member defining a central body of generally C-shape, proportioned to reside behind an ear. A lower portion of the ear ornament is attached to one end of the C-shaped central body, curving rearwardly from the central body in an arc and proportioned to curve about the front of an earlobe, to pass rearwardly along the outer face of the earlobe. An upper portion is attached to the other end of the C-shaped central body, to reside against the top of the ear and to curve toward the front of the ear in retentive relation thereto.

5 Claims, 4 Drawing Figures

FIG. 1
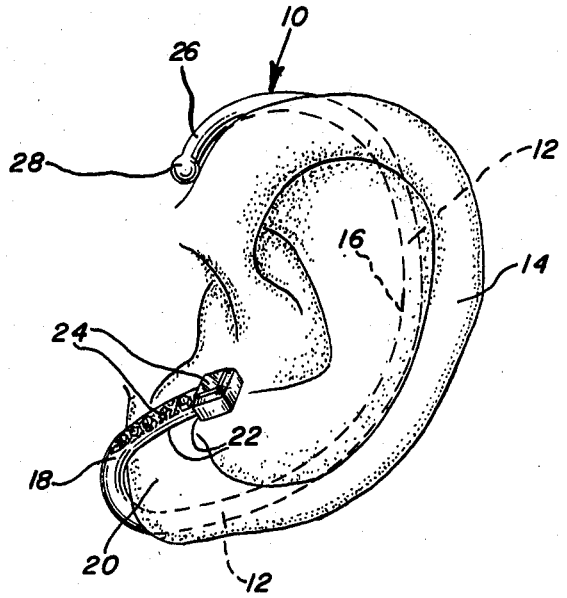
FIG. 2
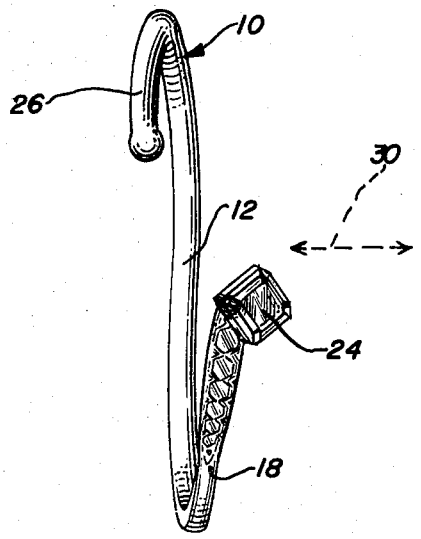
FIG. 3
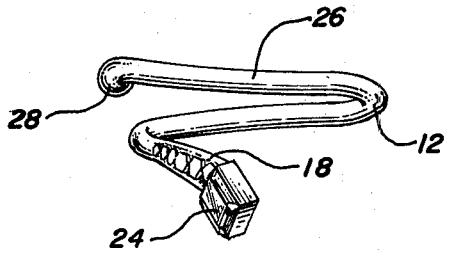
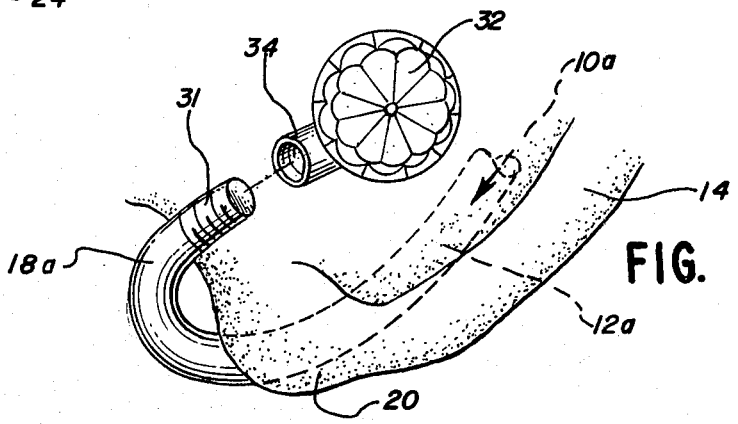
FIG. 4

EAR ORNAMENT

BACKGROUND OF THE INVENTION

Earrings, which are so very popular among women, are generally retained to the ear by being clamped to the earlobe, or, in the case of earrings for pierced ears, they pass through a perforation in the earlobe for firm retention.

It is a common problem for many that clamp-type earrings are painfully tight, squeezing the earlobes. Even then, such earrings are frequently lost.

This has resulted in the popularity of pierced ears, and the types of earrings usable therewith. However, the whole technique of pierced ears has its own array of disadvantages, including the possibilities of infection and scarring, as well as the expense and discomfort of the ear-piercing operation.

In accordance with this invention, a new type of ear ornament is disclosed. The ornament of this invention is comfortable to wear without pinching of the earlobe. It is retained by the ear in a highly reliable manner, but without any piercing or other mutilation of the ear. Also, it is easily put on and removed.

DESCRIPTION OF THE INVENTION

In accordance with this invention, an ear ornament is provided which comprises an elongated, curved rod member defining a central body of generally C-shape, proportioned to reside behind an ear.

A lower portion of the curved rod member is attached to one end of the C-shaped central body, curving rearwardly from the central body through an arc, and proportioned to curve about the front of an earlobe of the ear on which it is worn, to pass rearwardly along the outer face of the earlobe.

It is then preferred for an upper portion of the curved rod member to be attached to the other end of the C-shaped central body, to reside against the top of the ear, and to curve toward the front of the ear in retentive relation thereto.

The above ear ornament provides a stable frame which easily rests on the ear without discomfort, when properly proportioned, and is firmly retained by the ear until removal, which removal is easily accomplished simply by pulling the flexible ear through the generally C-shaped ear ornament.

While an ear ornament of one specific decorative design is disclosed herein, it is contemplated that the basic shape of ear ornament disclosed may be utilized in conjunction with a multitude of designs and decorative structures, which are typically carried on the upper and lower portions of the ear ornament. If desired, decorative structures may also be carried on the central body in any manner desired.

For example, either or both of the upper and the lower portions may carry decorative member means or not as desired, including any kind of precious, semi-precious, or costume jewelry, or other type of decorative display. Furthermore, either or both of the upper and lower portions may carry projecting members which, in turn, may carry decorations such as precious, semi-precious, or costume jewelry, or any other type of decoration. Additionally, the upper and lower portions may carry hooks, clasps, or other attachments for projecting members or dangling pendants of any type as may be desired in accordance with the dictates of fashion and the creativity of the manufacturer of the ear ornament of this invention.

Preferably, the lower portion curves rearwardly from the central body through an arc of essentially about 160° to 200°, to curve back about the earlobe and to cross at least a portion of its outer surface. This provides a surface for display of decoration as may be desired, but also serves as a gripping member of the lower portion of the ear ornament against the earlobe, providing stability against accidental removal.

Another factor which provides stability of the ear ornament of this invention against accidental removal is that the upper portion resides against the top of the ear and preferably may be adapted to curve toward the front of the ear, for retention of the top portion of the ear ornament.

In the drawings,

FIG. 1 is an elevational view of the ear ornament of this invention, shown in its emplaced position on an ear.

FIG. 2 is an elevational view of the ear ornament of FIG. 1, rotated 90° about a vertical axis from the ornament as displayed in FIG. 1.

FIG. 3 is a top plan view of the ear ornament of FIG. 2.

FIG. 4 is a fragmentary, enlarged elevational view of the lower portion of a modified ear ornament of this invention, shown emplaced on an ear.

Referring to FIGS. 1 through 3, ear ornament 10 comprises an elongated, curved rod member which may be made out of solid metal; preferably a precious metal such as gold, silver, platinum, or alloys thereof, but also including inexpensive versions of the ornament of this invention made out of base metals, plated metals, or other materials. Alternatively, the curved rod member may be hollow tubing for economy of material and weight, if desired.

The curved rod member defines a central body 12 which is shown in dotted lines in FIG. 1 because it is positioned behind ear 14. Central body 12 is preferably proportioned to rest against the rear external surface 16 in the channel defined behind ear 14, inwardly from the helix of the ear.

The C-shaped central body carries at one end thereof a lower portion 18 of the curved rod member which is attached to central body 12 and is preferably integral with it. Lower portion 18 curves, as shown in FIG. 1, rearwardly from central body 12 through an arc, preferably of about 180° and proportioned to curve about the front of earlobe 20, to then pass rearwardly along the outer face of earlobe 20 as illustrated, for example, by section 22 of lower portion 18.

If desired, lower portion 18 may be decorated with precious or semi-precious jewelry 24, for example, emeralds, diamonds, sapphires, rubies or any other desired decorations. Alternatively, as stated above, section 22 may carry one or more clasps, swivels, or hooks, to carry pendant decorations, or any other decorations as may be desired.

It can be seen that lower section 18 curves about earlobe 20 in an arc of approximately 180°, to provide a firm retention of the bottom of the ear ornament to earlobe 20, making accidental removal of the ornament 10 by disengagement of its bottom portion from the ear quite unlikely.

At the upper end of C-shaped central body 12, an upper portion 26 is provided, preferably also as an integral part of body 12. As shown, upper portion 26 can be proportioned to reside against the top of ear 14, and to curve toward the front of the ear in retentive relation thereto. This retentive relation serves to retain the top of ornament 10, so that the entire ornament is not easily removed by accident from the ear, yet at the same time it can be readily removed as desired.

Upper portion 26 may also carry decorations as may be desired including precious and semi-precious stones, pendants, or any other decoration. However, in the specific instances of FIG. 1, no decoration is utilized. Ball member 28 terminates the curved rod member of ear ornament 10, so that there are no sharp edges to scratch the ear.

It is preferred for ear ornament 10 to define a three-dimensional, irregular spiral structure as particularly shown in FIG. 2, in which the spiral structure extends in a dimension 30 which is normal to the generally C-shape of the central body as illustrated in FIG. 1. Specifically, it can be seen from FIG. 2 how lower portion 18 extends in the dimension depicted by line 30 substantially without retrogression to one side of central body 12 in the irregular spiral shape, while upper portion 26 extends in the same dimension 30 substantially without retrogression to the other side of central body 12. This provides comfort of wearing of the ear ornament of this invention, and also permits lower portion 18 to project across the outer face of earlobe 20 in a comfortable manner as illustrated in FIG. 1.

Referrring to FIG. 4, a modification of ear ornament 10*a* is disclosed. Except as shown, ear ornament 10*a* is identical in its structure to ear ornament 10. As shown, C-shaped central body 12*a* carries lower portion 18*a* at one end thereof. As in the previous embodiment, lower portion 18*a* curves about the front of earlobe 20 to pass rearwardly along the outer face of earlobe 20, as shown.

However, in this embodiment, lower portion 18*a* carries means 31 for removable connection with a decorative member 32 which, accordingly, may be removed or added as may be desired to ornament 10*a*. Specifically, means 31 may simply be screw threads positioned at the end of lower portion 18, and adapted to fit into threaded socket 34 of decorative member 32.

Accordingly, in this instance, ear ornament 10*a* may serve as a frame for carrying any one of a collection of removable decorative members 32 which may carry one or more precious or semi-precious stones or any other type of decoration, and also may include a hook or clasp for a pendant, or the like.

Thus the owner of ear ornament 10*a* in this instance may utilize it in conjunction with a collection of decorative members, so that she may have an ear ornament 10*a* which is of valuable gold or platinum construction, for example, and a variety of decorative members 32, giving the owner a variety of ear ornaments at greatly reduced cost, since the same ornament 10*a* may be used in conjunction with any of the decorative members 32.

The same system as shown in FIG. 4 may be utilized in conjunction with upper portion 26, if desired, so that interchangeable decorative members may be provided at either or both ends of the ear ornament of this invention.

Other attachment means of known design may be utilized as a replacement for members 31 and 34, as may be desired.

The ear ornament of this invention thus provides a versatile, new type of personal decoration, having a startlingly different effect from conventional earrings, while also exhibiting improvements in comfort, and with a significant reduction in the rate of accidental loss from the ear, particularly when compared with clamp-type earrings.

The above has been offered for illustrative purposes only, and is not intended to limit the invention of this application, which is as defined in the claims below.

That which is claimed is:

1. An ear ornament which comprises an elongated, curved rod member defining a stable frame proportioned to easily rest on an ear without discomfort, said member including a central body of generally C-shape, proportioned to reside behind an ear; a lower portion attached to one end of said C-shaped central body, said lower portion curving rearwardly from said central body through an arc, and proportioned to curve about the front of an earlobe to extend at least substantially across the entire earlobe; and an upper portion attached to the other end of said C-shaped central body to reside against the top of the ear and to curve toward the front of the ear in retentive relation thereto, said curved rod member defining a three-dimensional irregular spiral structure, with the irregular spiral extending in a dimension normal to said generally C-shape of the central body, said lower portion extending in said dimension, substantially without retrogression, to one side of the central body, said upper portion extending in said dimension, substantially without retrogression, to the other side of said central body.

2. The ear ornament of claim 1 in which said lower portion carries decorative member means.

3. The ear ornament of claim 1 in which said lower portion curves rearwardly from said central body through an arc of essentially 160° to 200°.

4. An ear ornament which comprises an elongated, curved rod member defining a stable frame proportioned to easily rest on an ear without discomfort, said member including a central body of generally C-shape, proportioned to reside behind an ear; a lower portion attached to one end of said C-shaped central body, said lower portion curving rearwardly from said central body through an arc and proportioned to curve about the front of the earlobe to pass rearwardly along the outer face of the earlobe and across at least substantially the entire extent thereof; said lower portion carrying means for removable attachment of decorative means to the lower portion, said means comprising threaded separable fitting means whereby the decorative means may be attached and detached by interengaging threads, and an upper portion attached to the other end of said C-shaped central body and proportioned to reside against the top of the ear and to curve toward the front of the ear in retentive relation thereto, said lower portion extending in said dimension, substantially without retrogression, to one side of the central body, said upper portion extending in said dimension, substantially without retrogression, to the other side of said central body.

5. The ear ornament of claim 4 in which said lower portion curves rearwardly from said central body through an arc of essentially 160° to 200°.

* * * * *